US009791212B2

(12) United States Patent
Hartschuh Schaub

(10) Patent No.: US 9,791,212 B2
(45) Date of Patent: Oct. 17, 2017

(54) BURNING SYSTEM

(76) Inventor: Ernesto Aldolfo Hartschuh Schaub, Sao Paulo (BR)

( * ) Notice: Subject to any disclaimer, the term of this patent is extended or adjusted under 35 U.S.C. 154(b) by 978 days.

(21) Appl. No.: 12/863,413

(22) PCT Filed: Jan. 18, 2008

(86) PCT No.: PCT/BR2008/000015

§ 371 (c)(1),
(2), (4) Date: Aug. 24, 2010

(87) PCT Pub. No.: WO2009/089599

PCT Pub. Date: Jul. 23, 2009

(65) Prior Publication Data

US 2011/0056476 A1 Mar. 10, 2011

(51) Int. Cl.

| | |
|---|---|
| ***F27B 9/40*** | (2006.01) |
| ***F27D 3/00*** | (2006.01) |
| ***F27B 9/36*** | (2006.01) |
| ***F27D 19/00*** | (2006.01) |
| ***F27D 21/00*** | (2006.01) |
| ***F27D 99/00*** | (2010.01) |

(52) U.S. Cl.
CPC ..... *F27B 9/36* (2013.01); *F27B 9/40* (2013.01); *F27D 19/00* (2013.01); *F27D 21/00* (2013.01); *F27D 99/0033* (2013.01)

(58) Field of Classification Search
CPC ..... F27B 9/40
USPC ..... 126/104 R, 108, 116 A; 432/246, 207, 432/128, 146
See application file for complete search history.

(56) References Cited

U.S. PATENT DOCUMENTS 2,502,204 A * 3/1950 Cole ..... C21D 1/767 266/254
2,564,700 A * 8/1951 Krejci ..... C09C 1/50 422/151
2,577,935 A * 12/1951 Van Der Pyl ..... F27B 9/20 432/128
3,160,009 A * 12/1964 Carney ..... 431/13
3,183,573 A * 5/1965 Alexander ..... 432/51
(Continued)

FOREIGN PATENT DOCUMENTS

DE 3835360 4/1990
DE 3835360 A1 * 4/1990
WO WO 94/07100 3/1994

OTHER PUBLICATIONS

International Search Report, mailed Feb. 10, 2009 of corresponding International Application PCT/BR2008/000015.
(Continued)

*Primary Examiner* — Avinash Savani
*Assistant Examiner* — Deepak Deean
(74) *Attorney, Agent, or Firm* — Alston & Bird LLP

(57) ABSTRACT

The present invention refers to an improved burning system for industrial furnace burners (16), more specifically for tunnel type furnaces for firing ceramic materials, to improve the thermal efficiency and reduce the consumption by these furnaces in the process of firing load (10) such as floor tiles, tiles, sanitary material, refractories, porcelain, insulators, grindstone, tableware ceramic, red ceramic and ceramic in general, by a using flame rotation system, providing a radiant flame surface by dividing the flame into smaller intermittent flames.

13 Claims, 7 Drawing Sheets

Cross-section view of the firing zone of a conventional furnace

(56) References Cited

U.S. PATENT DOCUMENTS 3,219,095 A * 11/1965 Nilsson ..... 236/15 A
4,067,682 A * 1/1978 Lado ..... 431/11
4,128,394 A * 12/1978 Naito et al. ..... 432/137
4,240,788 A 12/1980 Naito et al.
4,263,886 A * 4/1981 Batchelor ..... 126/116 A
4,412,814 A * 11/1983 Dennis et al. ..... 432/146
4,583,936 A * 4/1986 Krieger ..... F23C 6/045 236/15 BD
4,674,975 A * 6/1987 Corato et al. ..... 432/11
4,688,180 A * 8/1987 Motomiya ..... 700/210
4,773,850 A * 9/1988 Bushman et al. ..... 432/5
4,878,838 A * 11/1989 Verheyden, Jr. ..... 432/8
4,938,684 A * 7/1990 Karl et al. ..... 431/1
4,966,547 A * 10/1990 Okuyama et al. ..... 432/9
5,667,378 A * 9/1997 Bushman ..... 432/241
6,062,848 A * 5/2000 Lifshits ..... 431/285
6,234,789 B1 * 5/2001 Miyata ..... F23C 5/08 126/91 A
6,398,547 B1 * 6/2002 Joshi ..... F23C 15/00 431/12
7,548,796 B2 * 6/2009 Tanaka et al. ..... 700/210
8,247,741 B2 * 8/2012 Pepler et al. ..... 219/388
8,469,699 B2 * 6/2013 Leroux ..... C03B 5/2353 431/10
2004/0060490 A1 * 4/2004 Solis-Martinez ..... C03B 5/235 110/346
2006/0147867 A1 * 7/2006 Morel ..... 432/122
2008/0292999 A1 * 11/2008 Koder ..... F23C 7/008 431/1
2010/0284768 A1 * 11/2010 Olin-nunez ..... C03B 5/235 414/161
2010/0293999 A1 * 11/2010 Olin-Nunez ..... C03B 5/43 65/135.9

OTHER PUBLICATIONS

Written Opinion, mailed Feb. 10, 2009 of corresponding International Application PCT/BR2008/000015.

* cited by examiner

Cross-section view of the firing zone of a conventional furnace

Cross-section view of firing zone with new combustion system

Cross-section view of a furnace with new combustion system

Plan view of the injectors instant t4=t3+1

Injectors working 21,26,31,36

Plan view of the injectors instant t5=t4+1

Injectors working 22,28,33,38

Plan view of the injectors instant t6=t5+1

Injectors working 20,25,30,35

Plan view of the injectors
instant t1
Injectors working
20,25,30,35

Plan view of the injectors
instant t2=t1+1
Injectors working
22,27,32,37

Plan view of the injectors
instant t3=t2+1
Injectors working
24,29,34,39

BURNING SYSTEM

FIELD OF THE INVENTION

The present invention relates to an improved burning system in industrial furnace burners, more specifically for tunnel furnaces for burning ceramic material.

DESCRIPTION OF THE PRIOR ART

The tunnel type furnaces, also known as trolley furnaces, are widely known in the prior art and have been used for decades to fire ceramic products, refractories etc.

These furnaces basically operate as follows: the ceramic products, refractories etc, hereinafter referred to as "load", go into one end of the furnace in "raw" form and move along to the opposite end, where they come out "fired". However, for each product to be fired there are different ideal internal temperature curves, subdivided in each section of the furnace, so as to provide the material with the desired structural properties. For example, for chamotte, the temperatures should be around 1000° C. For sanitary porcelain, the temperatures should be around 1200° C. Other temperatures, such as 1450° C. for hard tableware porcelain, 1600° C. for high alumina materials, and up to 1850° C. for the firing of basic bricks (used in blast furnaces), can also be found.

These tunnel furnaces have a very good thermal efficiency compared to intermittent furnaces. This is due to many factors, among which the fact that, differently from what happens in intermittent furnaces, tunnel furnace insulations need not be heated.

As aforesaid, the material load in the trolleys goes in and moves continually along from one end of the furnace to the other, as in a conveyor belt, passing through several regions with different temperatures until the product is completely fired and cured. In the first region of the furnace, the raw material passes through the preheating zone, where the furnace usually has burners working only on the lower part of the load (between the upper insulation of the trolleys and the lower surface of the load support plates).

The second region through which the load passes is the main firing zone, which usually has burners on two levels, above and below the load.

Upon leaving the firing zone, the load goes through a transition stage and then into the rapid cooling region.

In this cooling region, which does not have burners, cold air is directly injected into the furnace, both under and over the load.

The fourth region through which the load passes is a transition zone called slow cooling zone, which precedes the fifth and last region, where the final cooling occurs by once again injecting a lot of air to cool the fired load to room temperature.

Some prior-art documents teach the implementation of industrial furnaces and their respective burners. However, their purposes are not at all similar to those of the present invention. Document GB 1,559,652, filed on Sep. 20, 1977, describes an oven suitable for firing ceramic materials, apparently aiming at high thermal efficiency, in which the ceramic articles are individually advanced along the oven. Nevertheless, they are used in ovens having rotating rollers which turn so as to advance the articles (load). These ovens, however, do not lower the gas consumption and do not even mention the use of burners. Ovens like these are still used, but they commonly present problems, which is why this type of double pass roller oven is not built anymore.

Document GB 2,245,693, filed on Jun. 27, 1991, describes a roller kiln for the firing of ceramic products, wherein the kiln flue is subdivided into one or more intermediate ceilings made of silicon carbide plate elements and the burners are directed into a space separated by intermediate ceilings for the heat to be applied directly. However, this document is directed to a specific problem which occurs with roller kilns for fine products. Furthermore, it does not aim at reducing the consumption of gas (fuel commonly used in this type of furnace).

British document GB 2,224,105, filed on Oct. 11, 1989, also refers to an industrial furnace. This furnace has a plurality of burners in which the secondary air can be used to feed the region of the burner flame in controlled amounts, according to the content of the gas component of the furnace. This document refers to the injection of secondary air into conventional burners. It is still widely used nowadays, but only in intermittent furnaces and for fine products. The secondary air reduces the temperature of the flame and increases the gas volume inside the furnace, making it homogenous. Contrary to the purpose of the present invention, the gas consumption increases considerably.

Another existing solution is found in U.S. Pat. No. 4,884,969, of Nov. 16, 1985. This document describes a tunnel kiln for ceramic products comprising a heating section, a firing section and a cooling section, where by means of gas conveying means gases are taken from the region of said cooling section and are conveyed to said firing section, whereby at least one additional burner is arranged in a transition region between said firing section and said cooling section. This document has a similar concept to that of the present invention, in that it uses the clean air from the bottom of the kiln as combustion and valid air. The first important difference lies in the fact that this invention has several burners/injectors in only two regions: the first one, which has 4 injectors and is located after the rapid cooling zone, is useful for homogenizing the temperatures and heating the kiln upon ignition, and the second one, which has 8 injectors and is located in the transition region between the firing zone and the rapid cooling zone. Furthermore, the invention uses conventional burners in the firing zone and comprises different burners in the 12 other injectors shown in FIG. 8. The second important difference lies in the fact that this prior-art document does not disclose a flame "rotation". With the static flame, the localized temperatures are very high, leaving marks on the products and cracking the injector's gas outlet. The present invention, on the other hand, proposes to place injectors all along the firing zone and to use flame rotation. This characteristic is important not to burn all the oxygen in one place only.

OBJECTS OF THE INVENTION

In view of the problems described and in order to overcome them, the present application proposes a system aimed at reducing in about 30% the fuel consumption in the load firing and curing processes in industrial furnaces.

Another aim of the invention is to avoid localized heating at the point where the flame forms by using flame rotation, and consequently avoiding undesirable marks in the end product and cracking of the injectors.

DETAILED DESCRIPTION OF THE INVENTION

The system presented herein can be better understood from the following detailed description of the figures.

Figure 1:
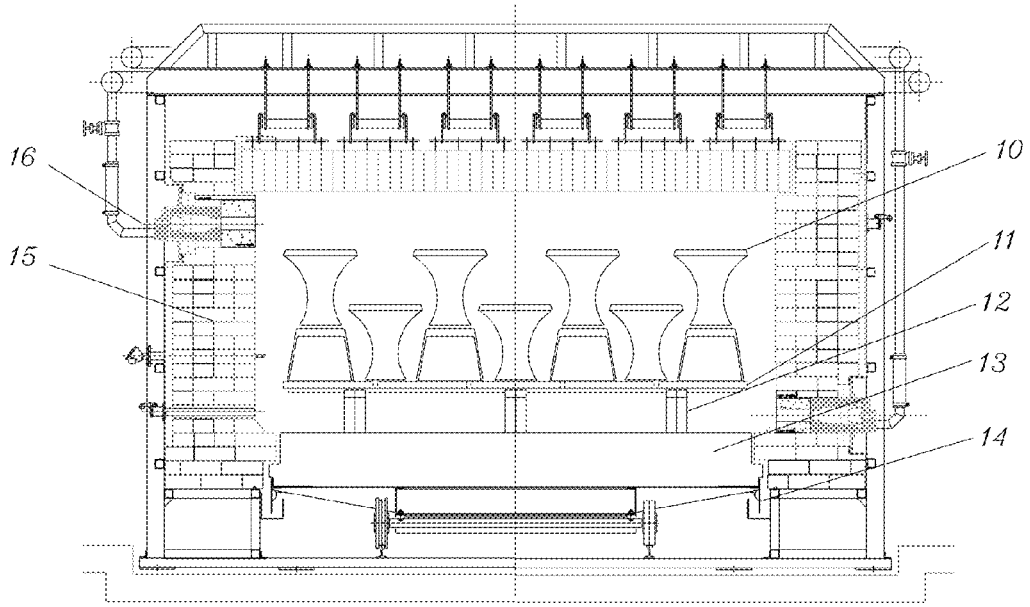
FIG. 1 illustrates a cross-sectional view of the firing zone of a conventional industrial furnace.
Figure 2:
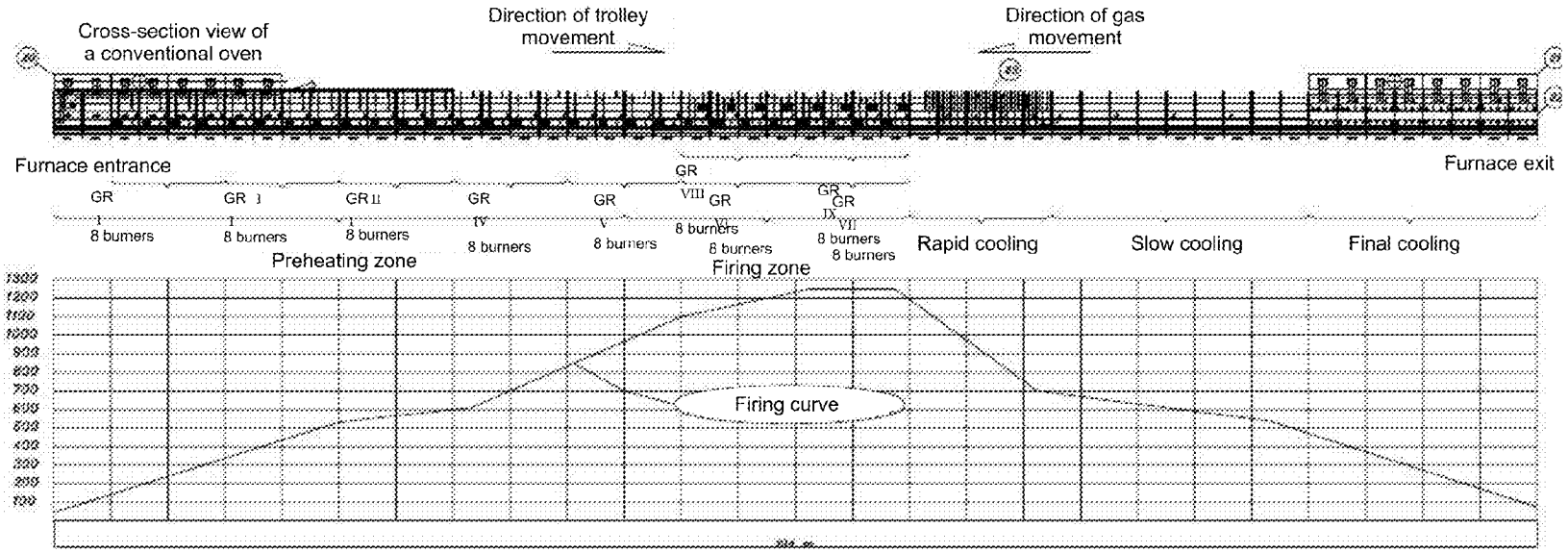
FIG. 2 shows the different regions of an industrial furnace and a chart with the specific firing curve of sanitary materials.

FIG. 1 illustrates a cross-sectional view of the firing zone of a conventional industrial furnace. The load 10, that is, the ceramic products, refractories etc., goes into the furnace in "raw" form, moves along inside it for hours, and comes out the opposite end, "fired". For each product there are internal temperature curves in each section of the furnace so as to provide the material with the desired properties. As can be seen in FIG. 2, the load moves along inside the furnace and passes through different regions and temperatures. The bottom chart in FIG. 2 illustrates a typical temperature curve for sanitary materials.

The furnace has ceramic insulation 15 on the sides and on the ceiling. The thickness of said insulation 15 depends on the characteristics of the latter and on the temperature in that region. Back to FIG. 1, on the lower part of the furnace, the insulation is provided by the trolleys 13, extremely resistant structures having a steel frame and cast iron wheels. These trolleys are positioned one directly after the other, from the entrance to the exit of the furnace. Only the first trolley needs to be pushed with a hydraulic cylinder for the whole trolley train to move forward one position. The forward speed of the cylinder that pushes the trolleys depends on the material to be fired.

The insulation and the support columns 12 of the load 10 support plates 11 are placed over the steel frame. In order to avoid gas from going into or coming out of the furnace through the sides of the trolleys, they have skirts 14 that slide along a chute filled with sand.

These tunnel furnaces have a very good thermal efficiency compared to intermittent furnaces. This is due to many factors, among which the fact that, differently from what happens in intermittent furnaces, tunnel furnace insulations need not be heated. Furthermore, as aforesaid, the material load in the trolleys goes in and moves continually from one end of the furnace to the other, as in a conveyor belt, passing through several regions with different temperatures until the product is completely fired and cured.

Figure 3:
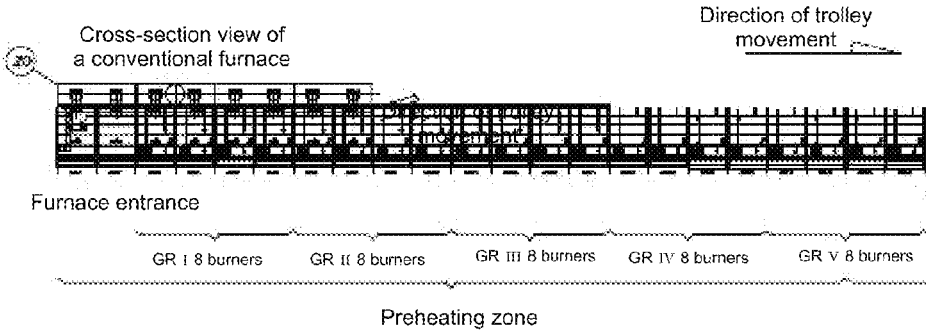
FIG. 3 illustrates the preheating zone of a furnace.

In the first region of the furnace, as can be seen in FIG. 3, the raw material passes, on the trolleys, through the preheating zone, where the furnace usually has burners working only on the lower part of the load (between the upper insulation of the trolleys and the lower surface of the load support plates).

Figure 4:
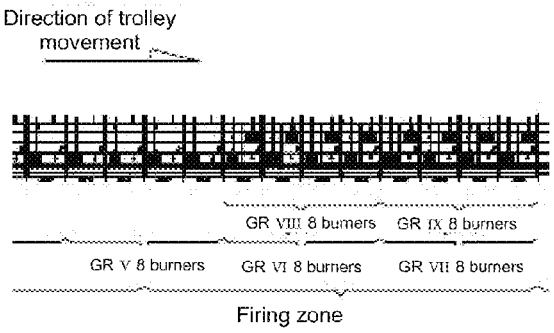
FIG. 4 illustrates the firing zone of a furnace.

In the second region, according to FIG. 4, the load passes through the main firing zone, which usually has burners 16 on two levels, above and below the load. The combustion gases generated move in the opposite direction and are sucked out by the furnace draft 20 in the entrance (illustrated in FIG. 3).

Upon leaving the firing zone, the load moves to a subregion, passing through a short transition zone, then moves to the third region, the rapid cooling zone 23. This cooling region does not have burners and this is where the cool air is directly injected into the furnace, both under and over the load.

Figure 5:
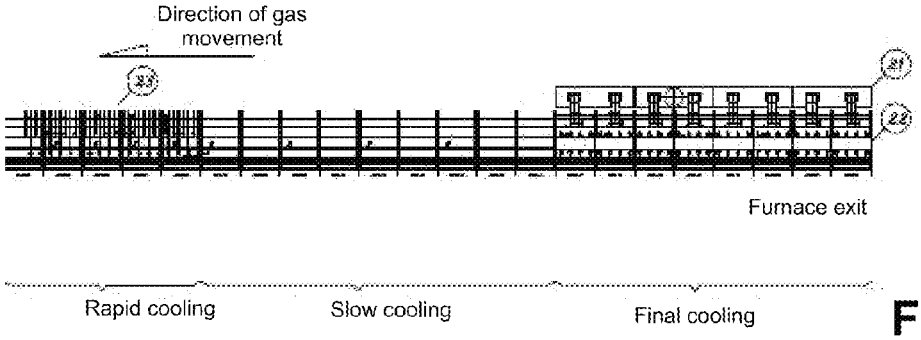
FIG. 5 illustrates the rapid cooling, slow cooling and final cooling zones of a furnace.

The fourth region through which the load passes is a transition zone called slow cooling zone, which precedes the fifth and last region, where the final cooling occurs by once again injecting a lot of air to cool the fired load to room temperature. These three last regions, the rapid cooling, slow cooling and final cooling zones, are illustrated in FIG. 5.

As can be noted from the description above, the air and its temperature are the key factors for perfectly curing the material to be fired, specially the cooling air. Part of the air is sucked out at the exit of the furnace by the hot air suction system 21. However, a large volume of the air is sucked out by the furnace draft, at the entrance of the furnace. It is precisely the air sucked out by the furnace draft that greatly distinguishes a tunnel furnace from an intermittent furnace.

Basically, this air is cold when it first goes into the furnace through the end opposite its entrance, and as it moves along in the opposite direction as the load, it "absorbs" the hot temperature of the material by heat exchange and cools the load. All this "cold" and pure air (approximately 21% of $O_2$) reaches the main firing zone with a temperature slightly lower (a difference of about 30° C.) than the firing temperature of the product. It should be pointed out that about 90% of this air moves along over and under the load. Most of this heat (flow rate×temperature×specific heat) is used to heat the load. This air is not found in intermittent furnaces.

In other words, these furnaces are big heat exchangers, in which the load moves from the entrance to the exit and the gases move from the exit to the entrance.

Tunnel furnaces used nowadays have burners divided into firing groups, as shown in the cross-section view of FIG. 1. A tunnel furnace has from 3 to 11 firing groups. Each module of the furnace is about 2 to 3 m long and the burners on the same side of the furnace are separated by a space of from 0.75 to 1.5 m. The burners on the opposite side, however, are not aligned.

Each conventional burner injects gas and air with an air excess factor in the range of from about 0.8 to 1.15 (normal variation). This means that, for example, in order to burn 1 $m^3$ of a natural gas, a minimum air volume of 8.5 $m^3$ is required to obtain the stoichiometric burning (air excess factor=1). Consequently, this means that the conventional burner injects, for each $m^3$ of gas, an air flow rate varying from 0.8×8.5=6.8 to 1.15×8.5=9.77 $m^3$ of air.

Generally, the cold ambient air is injected into the burners. Some furnaces, mainly the high temperature ones, have recovering systems to preheat the combustion air to temperatures of up to 400° C. The main aim of this preheating is to save energy. The higher the temperature of the combustion air, the higher the temperature of the flame and the lower the gas volume required to reach the same temperature. The adiabatic flame temperature, with dissociation, goes from 1971° C. with the air at 25° C. to 2543° C. with the air at 1100° C.

Ideally, from a theoretical point of view, the cold combustion air should not be injected directly into the conventional burners and the "preheated" air resulting from the cooling process should be used as combustion air. The basic idea would be to substitute a conventional burner with several injectors injecting pure gas or gas with an air excess factor of about from 0.1 to 0.2. However, this could be never accomplished in practice, mainly due to two factors: the overheating in the point where the flame is formed and the clogging of the gas outlet due to the cracking of the gas.

In order to solve the second problem, a special gas outlet can be designed and cooling water can be used all the way up to the exit etc. But as to the localized flame overheating problem, the present invention proposes to solve it with a radiant flame surface, by dividing the flame into several smaller intermittent flames instead of concentrating the flame in a single fixed point.

Figure 6:
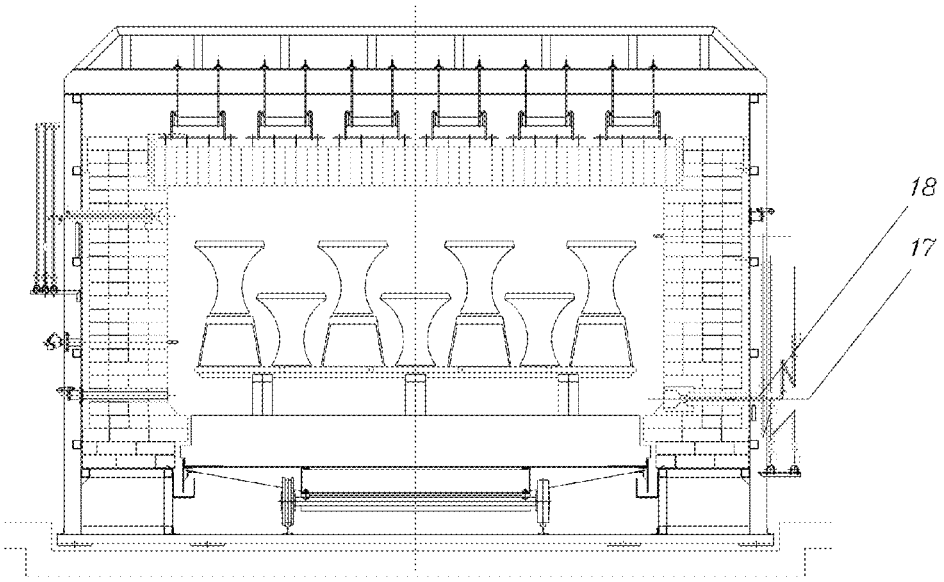
FIG. 6 illustrates a cross-sectional view of the firing zone of a furnace with the improved burning system.

Instead of using conventional burners in the firing zone (temperatures above 800° C.), the present invention seeks to implement several injectors injecting pure gas or gas with a very small amount of air 17, thus providing a pulsating firing, as shown in FIG. 6.

Figure 7:
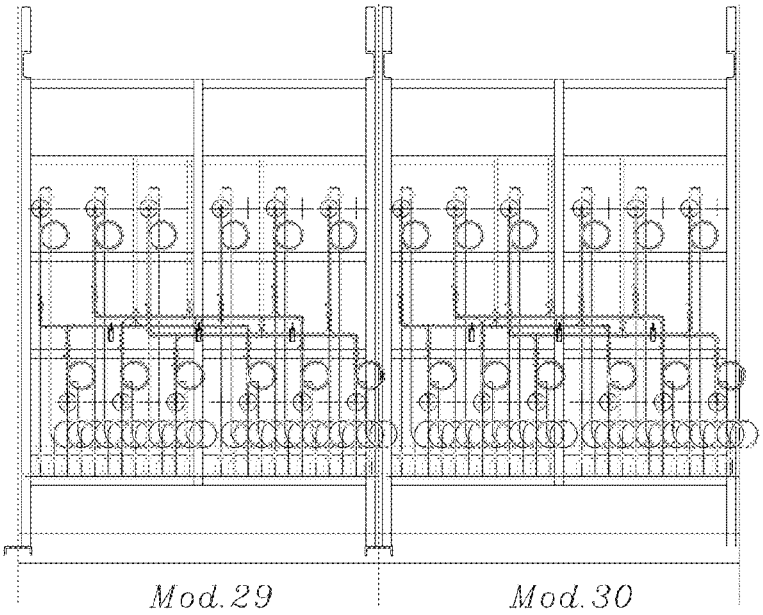
FIG. 7 illustrates an external view of the firing zone of a furnace with the improved burning system.

A controlling device, preferably a solenoid valve, but not limited to that, is inserted into each injector, so that the injectors work in rotation, responding to the signal of a programmable logic controller (PLC) with dedicated software. This avoids the occurrence of localized overheatings. FIG. 7 illustrates the external view of the furnace, including the plurality of injectors and their arrangement.

Figure 8A:
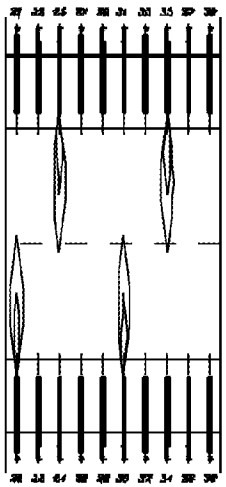
FIGS. 8A to 8F illustrate a plan view of the tunnel furnace injectors with the flames burning in rotation, at progressive time intervals.
Figure 8B:
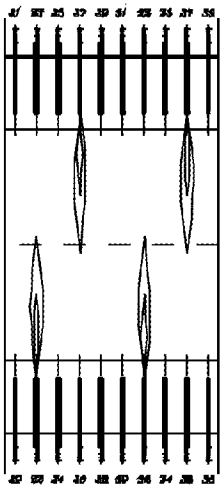
Figure 8C:
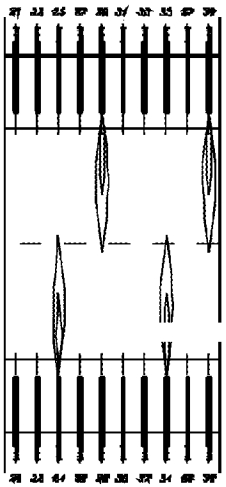
Figure 8D:
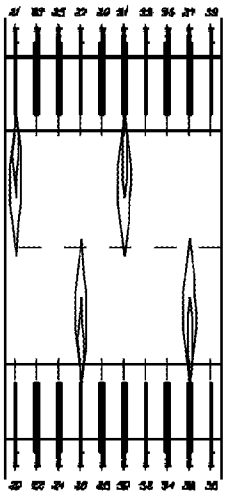
Figure 8E:
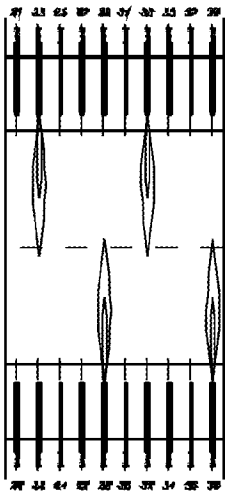
Figure 8F:
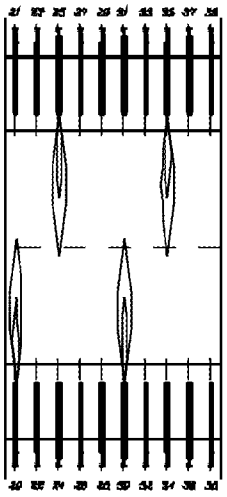

FIGS. 8A to 8F illustrate the injectors of the furnace firing alternately, in rotation. In FIG. 8A, among the injectors numbered from 20 to 39, the injector burners working in instant t1 are numbers 20, 25, 30 and 35. In an instant t2=t1+I, the injectors that were previously working are turned off and injectors 22, 27, 32 and 37 start working—FIG. 8B. In instant t3=t2+I, the previous injectors are turned off and the following ones, 24, 29, 34 and 39, start to fire, and so on, until instant t6, illustrated in FIG. 8F, which corresponds to the restart of the cycle beginning with t1. This time is controlled by the programmable logic controller (PLC) and the interval t can be set as required.

Figure 9B:
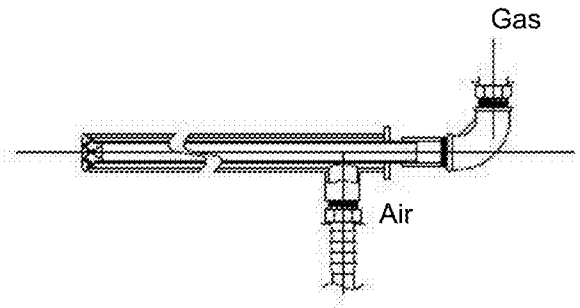
FIGS. 9A and 9B illustrate the burner injectors cooling systems by water jacket and by air jacket, respectively.
Figure 9A:
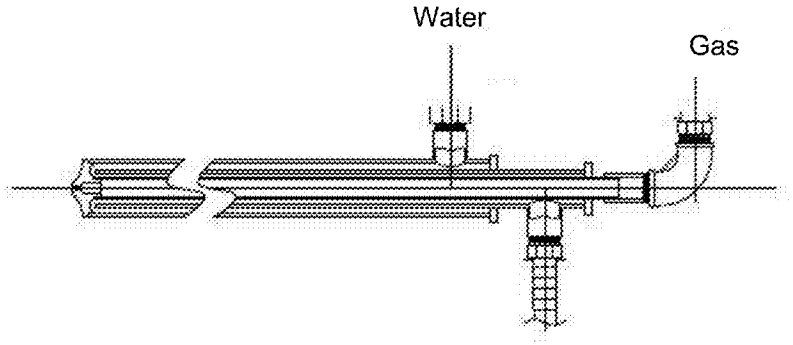

Furthermore, in order to avoid the cracking of the gas, it is possible to cool the tip of the injector by using a cooling device 18, preferably a water jacket, or by circulating a small amount of air through the injector. This cooling system is shown in FIGS. 9A and 9B. Similarly, in order to enhance the thermal efficiency, it is also possible to improve the cooling regions of the furnaces so as to obtain more air and higher temperatures of the air going into the firing zone by recirculating the air at the exit and by using the air recovered from the bottom of the furnace in the rapid cooling fan. This is accomplished by positioning recirculators on the ceiling at the exit of the furnace, thus considerably increasing the temperature of the cooling air. This resource is similar to increasing the size of the furnace, as if the exit end of the furnace was being "stretched".

Another possibility to increase the amount of hot air is by using preheated air instead of cold air in the rapid cooling fan. It should be noted that this air can be removed from the hot air at the exit of the furnace.

It should be further pointed out that the present invention can also be implemented in roller furnaces.

Therefore, it should be understood that the subject matter of the present invention and its component parts described above are part of some of the preferred modalities and of examples of situations that could happen, however, the real scope of the subject matter of the invention is defined in the claims.

The invention claimed is:

1. A ceramic tiles and sanitary ware burning system comprising:

a furnace having insulated walls and being divided into different regions with different temperatures, the different regions including a firing zone comprising at least one injector group comprising injectors, each injector defining an output tip and comprising a controlling device for independently activating each injector and being mounted in a side wall of the furnace; and a programmable logic controller (PLC) configured to alternatively activate the injectors of the at least one injector group in a loop condition at preset time intervals defining firing times to avoid localized overheating during a firing cycle, and wherein the firing cycle comprises more than two firing times;

wherein the PLC is configured to:

a) activate a first injector of the at least one injector group at a firing time t1;

b) activate a second injector of the at least one injector group at a firing time t2=t1+Δt and simultaneously turning off the preceding injector;

c) activate a third injector of the at least one injector group at a firing time t3=t2+Δt and simultaneously turning off the preceding injector;

d) rotating the injectors to be activated according to a)-c) in an incremented firing time in relation to the previous one until a firing time tn, wherein n is the total number of injectors in each of the at least one injector group; and e) repeating a)-d) in compliance with the formula t1=tn+Δt;

wherein each injector is active during a single firing time of the firing cycle and each injector is deactivated during n−1 firing times of the firing cycle; and wherein the burning system further comprises one or more cooling devices associated with each injector and configured to cool the output tip of the associated injector, the cooling devices comprising a fluid jacket located adjacent the output tip of the associated injector and configured for cooling the output tip of the associated injector by moving fluid through the fluid jacket.

2. The ceramic tiles and sanitary ware burning system of claim 1, characterized in that the PLC comprises a dedicated software, which considers at least one of an activation time of each of one or more injectors, a deactivation time of each of the injectors, a preset time, and a sequence of the loop condition to avoid localized overheating.

3. The ceramic tiles and sanitary ware burning system of claim 1, characterized in that the furnace is an industrial furnace of the tunnel type or roller type.

4. The ceramic tiles and sanitary ware burning system of claim 1, characterized in that the injectors inject pure gas or gas with an air excess factor between approximately 0.1 and 0.2.

5. The ceramic tiles and sanitary ware burning system of claim 1, wherein the fluid jacket comprises a water jacket configured for moving water through the water jacket, and wherein the injectors are configured for injecting supplied cold pure gas or supplied cold gas with an air excess factor approximately between 0.1 and 0.2.

6. The ceramic tiles and sanitary ware burning system of claim 1, characterized in that the cooling device comprises an air circulator configured for moving air through the fluid jacket and wherein the injectors are configured for injecting supplied cold pure gas or cold gas with an air excess factor approximately between 0.1 and 0.2.

7. The ceramic tiles and sanitary ware burning system of claim 1, characterized in that the controlling device is a solenoid valve configured to respond to a signal of the PLC.

8. A method for controlling a ceramic tiles and sanitary ware burning system in a furnace, the furnace having insulated walls and being divided into more than three different regions with different temperatures, the burning system comprising at least one injector group comprising injector burners installed in side walls of the furnace, certain injector burners in each of the at least one injector group being activated simultaneously and such that activated injector burners are spaced at regular intervals from deactivated injector burners, each injector burner defining an output tip for cold pure gas or cold gas with an air excess factor approximately between 0.1 to 0.2, and comprising a controlling device, wherein the burning system further comprises one or more cooling devices associated with each injector burner, each of the one or more cooling devices are configured to cool the output tip of the associated injector burner, the one or more cooling devices comprising a fluid jacket located adjacent the output tip of a respective injector burner, the method comprising the steps of:

a) activating a first plurality of the injector burners of each of the at least one injector group in an instant t1;

b) activating a second plurality of the injector burners of each of the at least one injector group in an instant $t2=t1+\Delta t$ and simultaneously turning off the preceding plurality of the injector burners;

c) activating a third plurality of the injector burners of each of the at least one injector group in an instant $t3=t2+\Delta t$ and simultaneously turning off the preceding plurality of the injector burners;

d) repeating steps a)-c) to alternatingly activate the injector burners in an incremented instant in relation to the previous one until an instant tn, wherein n is the total number of pluralities of the injector burners and each plurality of the injector burners is separately activated; and e) repeating the steps beginning with step a) in compliance with the formula $t1=tn+\Delta t$; and wherein each injector burner is active during a single instant of a firing cycle defined by steps a)-d), and each injector burner is deactivated during n−1 instants of the firing cycle.

9. The method of claim 8, characterized in that the first plurality of injector burners is activated in instant $t1=tn+\Delta t$.

10. The method of claim 8, characterized in that each step of activating a plurality of injector burners starts with outputting a signal generated by a programmable logic controller (PLC) to control a temperature variance, an activation time of each of the burners, a deactivation time of each of the burners, a preset time, a sequence of a loop condition and avoid localized overheating.

11. The ceramic tiles and sanitary ware burning system of claim 1, further comprising an air recirculator at the exit of the furnace configured to direct air toward and through the firing zone to enhance the thermal efficiency with high temperature air feedback.

12. The method of claim 8, characterized in that moving fluid through the one or more cooling devices comprises the step of moving water streaming in the one or more cooling devices and moving the pure gas or gas with an air excess factor approximately between 0.1 to 0.2 through the nozzle.

13. The method of claim 8, characterized in that moving fluid through the one or more cooling devices comprises the step of moving air with ambient temperature through the one or more cooling devices and moving the pure gas or gas with an air excess factor approximately between 0.1 to 0.2 through the nozzle.

* * * * *